US005876466A

United States Patent [19]

Nakashima et al.

[11] Patent Number: 5,876,466

[45] Date of Patent: Mar. 2, 1999

[54] SUEDE-LIKE ARTIFICIAL LEATHER

[75] Inventors: Hitoshi Nakashima, Kurashiki; Hisao Yoneda, Okayama, both of Japan

[73] Assignee: Kuraray Co., Ltd., Kurashiki, Japan

[21] Appl. No.: 937,185

[22] Filed: Sep. 29, 1997

[30] Foreign Application Priority Data

Sep. 27, 1996 [JP] Japan ..... 8-255904

[51] Int. Cl.[6] ..... D06P 1/22; D06P 1/30; D06P 3/24

[52] U.S. Cl. ..... 8/442; 8/490; 8/531; 8/611; 8/613; 8/650; 8/652; 8/924; 8/726; 8/515

[58] Field of Search ..... 8/442, 490, 531, 8/613, 611, 650–653, 924, 926, 515

[56] References Cited

U.S. PATENT DOCUMENTS

| | | | |
|---|---|---|---|
| 3,968,293 | 7/1976 | Cunningham et al. . | |
| 4,367,307 | 1/1983 | Hirai et al. | 524/590 |
| 4,775,386 | 10/1988 | Reinert et al. | 8/442 |
| 5,004,643 | 4/1991 | Caldwell | 428/246 |
| 5,277,969 | 1/1994 | Borri et al. | 428/252 |
| 5,436,399 | 7/1995 | Koyama et al. . | |

FOREIGN PATENT DOCUMENTS

| | | |
|---|---|---|
| 0 512 946 | 11/1992 | European Pat. Off. . |
| 57-58469 | 12/1982 | Japan . |
| 59-96118 | 6/1984 | Japan . |
| 59-51632 | 12/1984 | Japan . |
| 59-51633 | 12/1984 | Japan . |
| 61-6097 | 2/1986 | Japan . |
| 62-49883 | 10/1987 | Japan . |
| 6-37753 | 5/1994 | Japan . |

OTHER PUBLICATIONS

Database WPI, Section CH, Week 9034, Derwent Publications Ltd., London, GB; Class A18, AN 90–258565, XP002066967 & JP 02 182 981 A (Kohkoku Chem Ind Co Ltd)*Abstract*, patent date Jul. 1990.

Ando et al, "The Influence of Light Stabilizers on lightfastnese of Nitrocellulose group lacquer films", Hikaku Kagaku (1989) CA abstract.

*Primary Examiner*—Margaret Einsmann
*Attorney, Agent, or Firm*—Oblon, Spivak, McClelland, Maier & Neustadt, P.C.

[57] ABSTRACT

Suede-like artificial leather is described that is treated with at least one dye selected from the group consisting of sulfur dyes, vat dyes and sulfur vat dyes, and 2,2',4,4'-tetrahydroxy benzophenone. The suede-like artificial leather has excellent color resistance to light and color fastness to both washing and dry-cleaning.

17 Claims, No Drawings

SUEDE-LIKE ARTIFICIAL LEATHER

BACKGROUND OF THE INVENTION

1. Field of the Invention

The invention relates to a suede-like artificial leather that is excellent in color resistance to light, washing, and dry-cleaning. More specifically, the invention relates to a suede-like artificial leather suitable for use in clothes, shoes and gloves.

2. Description of the Prior Art

Conventional suede-like artificial leather sheets may be obtained by impregnating an entangled nonwoven fabric with a polyurethane solution, coagulating the polyurethane, then napping the surface. Laminating an additional polyurethane layer on the sheet surface results in a grain-imparted artificial leather.

Such artificial leathers however have insufficient light resistance and color fastness to washing. A number of proposals have been made in order to overcome these problems. Among them, for example, Japanese Patent Publication No. 5903/1982 has proposed a method of using a polyurethane composition to which a compound represented by the following formula (1) has been added for improving the polyurethane, which constitutes an artificial leather, thereby overcoming the above-described problems.

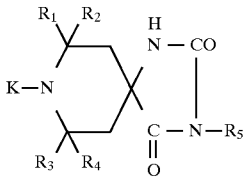

(1)

In formula (1), K represents a hydrogen atom or a benzyl group and $R_1$ to $R_5$ each represents a hydrogen atom or a hydrocarbon group.

Japanese Patent Publication No. 43590/1984 has proposed a method of use for an artificial leather a polyurethane composition to which a compound represented by the following formula (2) has been added.

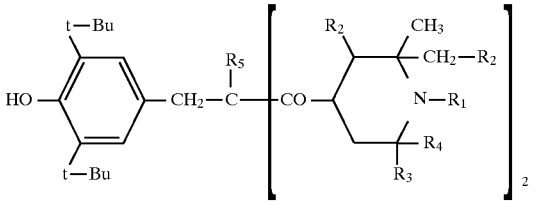

(2)

In formula (2), $R_1$ represents a hydrogen atom or a lower aliphatic group, $R_2$ represents a hydrogen atom or a lower alkyl group, $R_3$ and $R_4$ are the same or different and each represents a lower alkyl group and $R_5$ represents a lower aliphatic group.

In addition, it is known to add a stabilizer to a portion of the raw materials for the preparation of polyurethane, upon preparation of polyurethane, to bind the stabilizer with the polyurethane molecular chain or with the end of the polyurethane molecular chain, thereby improving the properties of polyurethane. For example, method, a method to bind a stabilizer with a hindered amine compound and use it as a portion of the raw materials for polyurethane has been proposed by Japanese Patent Publication Nos. 58469/1982, 51632/1984, 51633/1984, and 49883/1987.

Japanese Patent Publication Laid-Open No. 6097/1986 and Japanese Patent Publication Laid-Open No. 96118/1984 propose incorporating, in addition to the hindered amine, other compounds such as inorganic acid, an organic carboxylic acid, a derivative thereof or a polybasic acid for heightening the improving effects.

Japanese Patent Publication No. 37753/1994 proposes a method in which the surface of a suede-like artificial leather dyed with a metal-complex dye is treated with a hindered phenol compound and hindered amine compound as a light stabilizer.

As described above, incorporating a stabilizer in polyurethane with which a nonwoven fabric is impregnated or coated, or chemically binding a stabilizer with polyurethane have been conventionally adopted in artificial leather to improve the color resistance to light and color fastness to washing.

Many stabilizers however have inferior affinity with polyurethane so that some of these incorporated stabilizers move toward the surface of the polyurethane over time and then fall off the artificial leather, or suffer a change in quality, or fall off owing to the chemical or physical action exerted on them during the steps for preparing artificial leather. More specifically, wet coagulating the polyurethane solution, removing the solvent from the artificial leather by washing, dyeing or finishing, result in a loss in the effects of the stabilizer or color change caused by the deterioration of the stabilizer. Thus, some of the stabilizers sometimes bring about unfavorable conditions.

When an artificial leather is formed of a polyamide fiber, particularly, a microfine polyamide fiber, there is a limitation in the improvement of color resistance to light and color fastness to washing because the fiber itself also involves problems such as yellowing or brittleness. A metal-complex dye having a relatively good dyeing property and color resistance to light is conventionally used. However, when such a dye and a microfine polyamide fiber are used in combination, the resulting artificial leather has inferior color fastness to washing and unclear color; sufficient color variations or excellent color fastness to washing cannot be attained.

SUMMARY OF THE INVENTION

An object of the present invention is to provide a suede-like artificial leather having excellent color resistance to light and also having excellent color fastness to washing and dry-cleaning when used for clothes, shoes, gloves or the like.

These and other objects of the present invention have been achieved by a suede-like artificial leather having, at least on its surface, at least one dye selected from the group consisting of sulfur dyes, vat dyes and sulfur vat dyes and a benzophenone compound represented by the following formula (3):

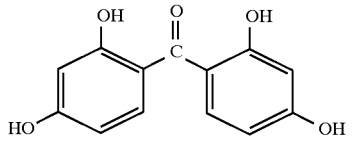

(3)

The first embodiment of the present invention relates to a suede-like artificial leather, which includes a treatment, the treatment including:

at least one dye selected from the group consisting of sulfur dyes, vat dyes and sulfur vat dyes; and a benzophenone compound represented by the following formula (3):

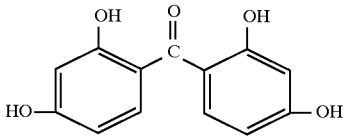

(3)

The second embodiment of the present invention relates to a process for producing a suede-like artificial leather, which includes:

dyeing a suede-like artificial leather with at least one dye selected from the group consisting of sulfur dyes, vat dyes and sulfur vat dyes; and treating the dyed artificial leather so obtained with a benzophenone compound represented by the following formula (3):

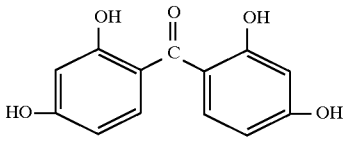

(3)

The third embodiment of the claimed invention relates to a process for dyeing a suede-like artificial leather, which includes:

dyeing a suede-like artificial leather with at least one dye selected from the group consisting of sulfur dyes, vat dyes and sulfur vat dyes; and treating the dyed artificial leather so obtained with a benzophenone compound represented by the following formula (3):

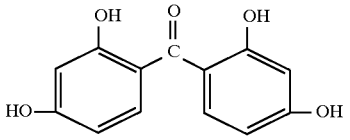

(3)

When a dye and a benzophenone compound, each specified in the present invention, are used in combination, a suede-like artificial leather is obtained that has excellent properties with respect to color resistance to light and color fastness to washing and dry-cleaning.

DETAILED DESCRIPTION OF THE PREFERRED EMBODIMENTS

Various other objects, features and attendant advantages of the present invention will be more fully appreciated as the same becomes better understand from the following detailed description of the performed embodiments, which are not intended to be limiting thereof.

A 2,2',4,4'-tetrahydroxy benzophenone represented by the above-described formula (3) in the present invention is a compound belonging to the so-called benzophenone ultraviolet absorbers. There are many kinds of ultraviolet absorbers which are generally used as an additive for high molecular weight substances. Examples include benzotriazole compounds, hindered amine compounds, salicylic acid derivatives and benzophenone compounds. Specific examples of the benzophenone compound include 2,4-dihydroxy benzophenone, 2,2'-dihydroxy-4-methoxy benzophenone, 2-hydroxy-4-methoxy-2'-carboxy benzophenone, 2-hydroxy-4-octoxy benzophenone, sodium 2,2'-dihydroxy-4,4'-dimethoxy-5-sulfo benzophenone, 5-chloro-2-hydroxy benzophenone, 2,4-dibenzoylresorcinol and 2,2',4,4'-tetrahydroxy benzophenone, and the like. As the dye used for dyeing a polyamide fiber, acid dyes, disperse dyes, metal-complex dyes are common; direct dyes, naphthol dyes, vat dyes, sulfur dyes, and sulfur vat dyes are used, though not so frequently.

It has been found in the present invention that by using a specific benzophenone compound, i.e., 2,2',4,4'-tetrahydroxy benzophenone and a specific dye (that is, a vat dye, sulfur dye or sulfur vat dye) in combination, excellent color resistance to light, and color fastness to washing and dry-cleaning unattainable by the other combination can be attained.

The suede-like artificial leather of the present invention includes, as a base, an entangled nonwoven fabric made of microfine polyamide fibers having an average fineness of 0.5 denier or smaller; a porous or nonporous polyurethane incorporated inside of the nonwoven fabric; and at least one surface napped, so that it is covered with fibrous nap composed of the base-constituting fibers. The suede-like artificial leather is dyed with at least one dye selected from the group consisting of sulfur dyes, vat dyes and sulfur vat dyes, thereby being colored to a desired color; and then the surface of the colored suede-like artificial leather is coated with a solution containing a benzophenone compound represented by the above-described formula (3) to adhere the benzophenone compound to the surface portion. It is also possible to adhere the benzophenone compound to not only the surface but also to the inside of the suede-like artificial leather by impregnating the colored suede-like artificial leather with a benzophenone solution or dipping it in the solution. By covering the dye adhered to the surface of the suede-like artificial leather with the benzophenone compound, its color resistance to light shows a marked improvement.

In the above manner, a suede-like artificial leather is produced having, on at least the napped surface of the suede-like artificial leather, at least one dye selected from the group consisting of sulfur dyes, vat dyes and sulfur vat dyes and a benzophenone compound represented by the above-described formula (3).

The term "the surface of the suede-like artificial leather" as used herein means the napped portion. By dyeing a suede-like artificial leather with a dye composed mainly of a sulfur dye, vat dye or sulfur vat dye and then adding a benzophenone compound represented by the above-described formula (3), the benzophenone compound and dye exist on the napped portion. It is also possible that the dye or the benzophenone compound may penetrate into the suede-like artificial leather.

Examples of the polyamide microfine fiber forming an entangled body of a suede-like artificial leather of the present invention include 6-nylon, 6,6-nylon, 6,10-nylon, nylon having an aromatic ring and copolymers composed mainly thereof The aromatic ring is preferably a $C_{6-10}$ aromatic ring that is unsubstituted or substituted with a $C_{1-10}$ alkyl group, halogen, hydroxy, nitro group and mixtures thereof The above microfiber is produced, for example, by the following process. First, a multi-component fiber composed of at least two polymers is formed by a process in which at least two polymers having a low compatibility or solubility with each other are mixed and melted and then this molten mixture is spun; or by a process in which at least two polymers having no compatibility or solubility with each other are melted respectively and combined in the vicinity of a spinning nozzle are spun. In the multi-component fiber so obtained, at least one polymer forms a dispersed phase (island component, that is, microfine denier fiber component) and the other polymer forms a phase of dispersing medium (sea component). They form a sea-island structure in which the island component is covered with the sea component in the cross-sectional direction of the fiber. In the present invention, the polyamide fiber corresponds to the island component. In the present invention, it is also possible that one of the two polymers is divided by the other polymer in the cross-sectional direction of the fiber, in other words, two polymers each forms plural layers in the fiber length direction and these layers are laminated into one fiber. A fiber having island components (that is, microfine fiber) converged in the form of a bundle can be obtained by removing the sea component (even in the case of the divided form, the polymer other than the polyamide is called a sea component) from the multi-component fiber by dissolution or decomposition, thereby leaving the island component.

Examples of the sea component include polyethylene, polystyrene, ethylene propylene copolymers, and sodium sulfoisophthalic acid copolymerized polyester and mixtures thereof.

The average single fineness of the microfine polyamide fibers has an influence on the feeling and appearance of the suede-like artificial leather. When cattle-hide or sheep-skin suede-like artificial leather is preferred, microfine fibers having an average single fineness of 0.5 denier or smaller, preferably 0.1 denier or smaller, more preferably within a range of 0.05 to 0.0001 denier are used. When the average single fineness exceeds 0.5 denier, the resulting suede-like artificial leather is preferable in properties such as depth of the color when dyed, dyeing fastness and rubbing resistance, but is not preferable in the feel or appearance in order to obtain a cattle-hide or sheep-skin suede-like or nubuck-like artificial leather, which is an object of the present invention.

Examples of the polyurethane to be incorporated in the fiber entangled nonwoven fabric include polyester-polyurethane, polyether-polyurethane, polyester-ether-polyurethane, polylactone-polyurethane and polycarbonate-polyurethane. The polymers may be obtained by solution polymerization, melt polymerization or bulk polymerization of at least one polymer diol which has an average molecular weight of 700 to 3000 and is selected from the group consisting of polyester diols, polyether diols, polyesterether diols, polylactone diols and polycarbonate diols; an organic isocyanate composed of, as a main component, at least one organic diisocyanate selected from the group consisting of aromatic diisocyanates and alicyclic diisocyanates and, optionally, another organic diisocyanate or an organic tri-isocyanate; and a low molecular weight compound having two active hydrogen atoms such as a low molecular weight diol, low molecular weight diamine, hydrazine or hydroxyamine.

The above-exemplified polyurethane is dissolved in a solvent or dispersed in a dispersing agent to obtain a polyurethane liquid. A fiber-entangled non-woven fabric is impregnated with the polyurethane liquid, followed by treatment with a non-solvent of the polyurethane to effect wet coagulation or by dry coagulation. The sea component polymer of a multi-component fiber is removed by dissolution, whereby a fibrous base sheet composed of a microfine fiber and polyurethane is produced. Alternatively, the sea component polymer of a multicomponent fiber is removed by dissolution prior to the impregnation of the fiber entangled nonwoven fabric with the polyurethane liquid.

The fibrous base sheet so obtained may be sliced into a predetermined thickness or not sliced. At least one surface of the sheet, which will be a surface of the product, is preferably subjected to a buffing treatment by sand paper or a napping treatment by a napping machine to form a napped surface composed of microfine polyamide fibers. After various steps including washing treatment, a suede-like artificial leather is obtained. It is preferred that the weight ratio of the polyurethane in the suede-like artificial leather is 20 to 60% by weight.

The suede-like artificial leather so obtained is then dyed. The dye used for dyeing is at least one selected from the group consisting of sulfur dyes, vat dyes and sulfur vat dyes. These dyes are insoluble in water and are therefore excellent in washing fastness and well-suited for use in the dyeing of an artificial leather which tends to be used in contact with water, for example, clothes, shoes and gloves. The dyeing is carried out under the conditions generally known in the art by using an ordinary dyeing machine. No particular limitation is imposed on the dyeing method, but dip dyeing and gravure dyeing methods can be given as examples. The dip dyeing method is preferred in consideration of the feeling and color fastness of the leather used for clothes, shoes or gloves. Examples of the dyeing machine include wince dyeing machine, circular dyeing machine, dashline dyeing machine and jigger dyeing machine, with the circular dyeing machine, which can be hermetically sealed, being preferred.

The dyeing is carried out as follows: a suede-like artificial leather is dyed with the above-exemplified dye which has been reduced in advance under basic conditions; or a suede-like artificial leather is immersed with a liquid in which the dye has been dispersed, followed by the addition of a reducing agent under basic conditions; or by the addition of a reducing agent to form basic conditions. The concentration of the dye at this time is preferably 0.01 to 30%, particularly 0.5 to 10% based on the weight of the suede-like artificial leather. Examples of the substance to form basic conditions include sodium hydroxide, sodium carbonate and sodium bicarbonate. Examples of the reducing agent include hydrosulfite, sodium sulfoxylate formaldehyde, sodium hydrogen sulfide, sodium sulfide and thiourea dioxide. They can be used either singly or in combination. The dyeing temperature is preferably 60° C. or higher. Dyeing temperatures lower than 60° C. prevent sufficient color development, resulting in a pale or unclear color. The dyeing time is at least 10 minutes, with about 30 to 60 minutes being preferred. A reducing agent may be added further as needed to effect the dyeing.

After dyeing, the dye is oxidized to make it insoluble in water. No particular limitation is imposed on the oxidizing method but oxidation with a chemical is efficient and is therefore preferred. As the oxidizing agent usable in the present invention, those commonly employed in the dye works such as hydrogen peroxide, potassium bichromate or perboric acid are used. The suitable amount of the dye to be adhered to the suede-like artificial leather falls within a range of 80 to 95% of the above-described dye concentration, i.e., within a range of 0.008 to 27% based on the weight of the artificial leather. The suede-like artificial leather dyed according to the present invention has excellent washing fastness of color and dry-cleaning fastness of color and, in addition, exhibits clear color development.

The 2,2',4,4'-tetrahydroxy-benzophenone compound represented by the above-described formula (3), when added to a dyed suede-like artificial leather, prevents color change in the leather, which includes the yellowing of the polyamide fiber and polyurethane. The 2,2',4,4'-tetrahydroxy benzophenone compound can be applied to the suede-like artificial leather in the form of a solution or an aqueous emulsion.

When used in solution, examples of the solvent include methanol, ethyl acetate and methyl ethyl ketone. The amount of the 2,2',4,4'-tetrahydroxy benzophenone compound adhered to the suede-like artificial leather is at least 0.1 wt. % but not greater than 15 wt. % based on the amount of the leather. When the amount adhered to the leather is smaller than the above range, sufficient stabilizing effects cannot be brought about. Even if the amount is increased outside the above range, the eminent effect in proportion to the amount added cannot be obtained.

The benzophenone compound dissolved in a solvent or in the form of an aqueous emulsion is preferably applied mainly to the surface of the suede-like artificial leather. It can be applied, for example, by the gravure roll coater, reverse roll coater, spray coater or curtain flow coater method, followed by the removal of the solvent or water by evaporation. The dip coating of the suede-like artificial leather in a solution or dispersion of the above benzophenone compound or application by the dip nip method has also excellent effects when the compound adheres much to the surface. To the liquid containing the above benzophenone compound, it is also possible to preliminarily add, as a spreading agent, a polymer that does not cause color change of the surface. For example, polycarbonate-base polyurethane or yellowing-free polyurethane may be added as spreading agents to the extent that they do not impair the various properties such as napped condition, feeling and appearance of the suede-like artificial leather.

It is also preferred to subject the suede-like artificial leather to a crumpling treatment or surface brushing treatment to modify its feeling or appearance as needed.

The suede-like artificial leather obtained according to the present invention has excellent color resistance to light as well as excellent color fastness to both washing and dry-cleaning.

EXAMPLES

Having generally described this invention, a further understanding can be obtained by reference to certain specific examples which are provided herein for purposes of illustration only and are not intended to be limiting unless otherwise specified.

The term "average fineness" as used herein is determined by taking the micrograph of the cross-section of the fiber by an electron microscope before the sea component is removed by extraction, counting the total denier of the island components forming one fiber and the number of the islands and then dividing the total denier by the number of the islands. In the examples, all designations of "part" or "parts" and "%" mean part or parts by weight and wt. % unless otherwise specifically indicated. The amount of the dye adsorbed is determined by measuring the amount of the dye that remains in the dye solution after dyeing.

Example 1

A fiber-entangled non-woven fabric having an average weight of 650 g/m$^2$, produced from a multi-component fiber having a fineness of 4.5 deniers, which fiber is composed of 40 parts of a high-fluidity polyethylene (sea component) and 60 parts of 6-nylon (island component), was impregnated with a solution containing 13 parts of a polyurethane composition composed mainly of a polyether base polyurethane and 87 parts of dimethyl-formamide, followed by wet coagulation, whereby a fibrous sheet containing 168 g/m$^2$ of polyurethane was obtained. The fibrous sheet so obtained was treated in hot toluene to remove the polyethylene component from the fiber by dissolution, whereby a fibrous sheet (A) having a fiber-entangled non-woven fabric of 6-nylon microfine fiber bundles (average fineness of 0.05 denier) with polyurethane incorporated therein and having a thickness of about 1.3 mm was obtained.

The fibrous sheet (A) was centrally sliced into two portions. The surface at the time of coagulation was napped by an emery buffing machine, followed by brushing, whereby a suede-like sheet (B) having an average thickness of 0.5 mm was obtained. The suede-like sheet (B) so obtained was dyed red with a vat dye.

| | |
|---|---|
| Dyeing | |
| Indanthren Red FBB (BASF) | 4.0% owf |
| Reducing agent (hydrosulfite) | 15 g/liter |
| Sodium hydroxide | 2 g/liter |
| Bath ratio | 1:100 |
| Temperature; time | 70° C.–30 min. |
| Dyeing machine | circular dyeing machine |
| Oxidation | |
| Hydrogen peroxide (30%) | 3 g/liter |
| Acetic acid | 3 g/liter |
| Temperature; time | 60° C.–30 min. |

The red suede-like sheet obtained by washing and drying after dyeing was then brushed and crumpled, whereby a suede-like product (C) was obtained. By the dyeing treatment, the dye was adhered to the suede-like product (C) in an amount of 3.5 wt. % based on the weight of the suede-like sheet before dyeing.

Then, a solution (A-1) composed of 10 parts of 2,2'4,4'-tetrahydroxy benzophenone and 90 parts of methyl ethyl ketone (which will hereinafter be abbreviated as "MEK") was applied to the fiber napped surface of the suede-like product (C) by the gravure roll coating method, followed by drying and brushing, whereby a suede-like sheet product (D) was obtained. The amount of the benzophenone compound adhered was 1.0% based on the weight of the artificial leather (C). The light resistance test, washing test and dry cleaning test of the suede-like sheet product (D) so obtained were carried out by a fadeometer and results are shown in Table 1. Table 1 shows that the suede-like artificial leather according to the present invention has excellent color resistance to light, washing and dry-cleaning, and is excellent in both appearance and touch feeling.

Example 2

The suede-like sheet (B) obtained in Example 1 was dyed dark blue with a sulfur dye.

| | |
|---|---|
| Dyeing | |
| Asathiosol Pure Blue S-GL (product of Asahi Chemical Industry) | 8.0% owf |
| Reducing agent (sodium hydrogen sulfide) | 7 g/liter |
| Bath ratio | 1:100 |
| Temperature; time | 70° C.–30 min. |
| Dyeing machine | circular dyeing machine |
| Oxidation | |
| Hydrogen peroxide (30%) | 3 g/liter |
| Acetic acid | 3 g/liter |
| Temperature; time | 60° C.–30 min. |

After dyeing, the suede-like sheet was treated as in Example 1, whereby a suede-like product (E) was obtained.

The suede-like product (E) was treated with the solution (A-1) in a similar manner to Example 1, whereby a suede-like product (F) was obtained. The amount of the dye adhered to the suede-like product (E) was 6.8% based on the amount of the suede-like sheet before dyeing and the amount of the benzophenone compound adhered was 1.0% based on the suede-like product (E). The fadeometer results of the light resistance and washing tests show that the suede-like product (F) exhibited excellent 6th grade color resistance to light and 5th grade color fastness to washing and dry-cleaning.

Example 3

The suede-like sheet (B) obtained in Example 1 was dyed blue with a sulfur vat dye.

| Dyeing | |
|---|---|
| Hydoron Blue 3RC (Dystar) | 4.0% owf |
| Reducing agent (hydrosulfite) | 7 g/liter |
| Bath ratio | 1:100 |
| Temperature; time | 70° C.–30 min. |
| Dyeing machine | circular dyeing machine |
| Oxidation | |
| Hydrogen peroxide (30%) | 3 g/liter |
| Acetic acid | 3 g/liter |
| Temperature, time | 60° C.–30 min. |

After dyeing, the suede-like sheet was treated as in Example 1, whereby a suede-like product (G) was obtained. The suede-like product (G) was treated with the solution (A-1) in a similar manner to Example 1, whereby a suede-like product (H) was obtained. The amount of the dye adhered to the suede-like product (G) was 3.6% based on the amount of the suede-like sheet before dyeing and the amount of the benzophenone compound adhered was 0.9% based on the suede-like product (G). The fadeometer results of the light resistance and washing tests show that the suede-like product (H) exhibited excellent 6th grade color resistance to light and 5th grade color fastness to washing and dry-cleaning.

Comparative Example 1

To the dyed suede-like product (C) obtained in Example 1, a solution (A-2) composed of 10 parts of 2,2'-dihydroxy-4,4'-dimethoxy benzophenone represented by the below-described formula (4) and 90 parts of MEK was applied by the gravure roll method, followed by drying and brushing, whereby a suede-like sheet product (I) was obtained. The amounts of the dye and benzophenone compound adhered to the product were the same as those of Example 1. In the light resistance and washing tests, the suede-like sheet product so obtained showed excellent 5th grade washing fastness but the color resistance to light was 4th grade, and yellowing appeared.

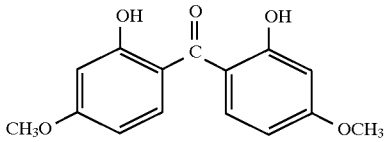

(4)

Comparative Example 2

The suede-like sheet (B) obtained in Example 1 was dyed red with a metal-complex dye.

| Dyeing | |
|---|---|
| Irgalan Red 2GL (Ciba) | 4.0% owf |
| Bath ratio | 1:100 |
| Temperature; time | 90° C.–30 min. |
| Dyeing machine | circular dyeing machine |

The suede-like sheet so dyed was treated as in Example 1, whereby a suede-like product (J) was obtained. The suede-like product (J) was treated with the solution (A-1) in a similar manner to Example 1, whereby a suede-like product (K) was obtained. The amount of the dye adhered was 3.53% based on the amount of the suede-like sheet and the amount of the benzophenone compound adhered was the same as that in Example 1. The fadeometer results of the light resistance test and washing test show that the suede-like product (K) exhibited excellent 6th grade color resistance to light but the washing fastness was on the 3rd grade. In addition, it was found that the red dye fell off.

The color resistance to light and color fastness to washing and dry-cleaning of the suede-like artificial leather so obtained are shown in Table 1.

Comparative Example 3

To the dyed suede-like product (C) obtained in Example 1, a solution composed of 10 parts of 4-tert-butylphenylsalicylate and 90 parts of methyl ethyl ketone was applied by the gravure roll method, followed by drying and brushing, whereby a suede-like sheet product (L) was obtained. The amount of the 4-tert-butylphenylsalicylate adhered was the same as that of the benzophenone compound in Example 1. The light resistance test and washing test of the suede-like sheet product were carried out using a fadeometer. The results are shown in Table 1.

Comparative Example 4

A suede-like sheet product (M) was obtained in a manner similar to Comparative Example 3 except that 4-tert-butylphenylsalicylate was replaced by 5-chloro-2-hydroxybenzophenone. The amount of the 5-chloro-2-hydroxy benzophenone that adhered to the product was the same as that of the benzophenone compound in Example 1. The light resistance test and washing test of the suede-like sheet product so obtained were carried out using a fadeometer. The results are shown in Table 1.

Comparative Example 5

A suede-like sheet product (N) was obtained in a manner similar to Comparative Example 3 except that 4-tert-butylphenylsalicylate was replaced by 2,4-dibenzoyl-resorcinol. The amount of the 2,4-dibenzoyl-resorcinol that adhered to the product was the same as that of the benzophenone compound in Example 1. The light resistance test and washing test of the suede-like sheet product so obtained were carried out using a fadeometer. The results are shown in Table 1.

Comparative Example 6

A suede-like sheet product (P) was obtained in a manner similar to Comparative Example 3 except that 4-tert-butylphenylsalicylate was replaced by 2-(2'-hydroxy-5'-methylphenyl) benzotriazole. The amount of the 2-(2'-hydroxy-5'-methylphenyl) benzotriazole that adhered to the product was the same as that of the benzophenone compound in Example 1. The light resistance test and washing test of the suede-like sheet product so obtained were carried out using a fadeometer. The results are shown in Table 1.

Comparative Example 7

A suede-like sheet product (Q) was obtained in a manner similar to Comparative Example 3 except that 4-tert-butylphenylsalicylate was replaced by 2-hydroxy-4-methoxybenzophenone. The amount of the 2-hydroxy-4-methoxybenzophenone that adhered to the product was the same as that of the benzophenone compound in Example 1. The light resistance test and washing test of the suede-like sheet product so obtained were carried out using a fadeometer. The results are shown in Table 1.

TABLE 1

| | Light resistance (class) | Washing fastness (change in color/stain) (class) | Dry-cleaning fastness (change in color/stain) (class) |
|---|---|---|---|
| Example 1 | 6 | 5/5 | 5/5 |
| Example 2 | 6 | 5/5 | 5/5 |
| Example 3 | 6 | 5/5 | 5/5 |
| Comp.Ex.1 | 4 | 5/5 | 5/5 |
| Comp.Ex.2 | 6 | 3/3 | 4/4 |
| Comp.Ex.3 | 4 | 5/5 | 5/5 |
| Comp.Ex.4 | 4 | 5/5 | 5/5 |
| Comp.Ex.5 | 4 | 5/5 | 5/5 |
| Comp.Ex.6 | 4 | 5/5 | 5/5 |
| Comp.Ex.7 | 4 | 5/5 | 5/5 |

Concerning the light resistance (color resistance to light), 8th grade is best, and the light resistance becomes inferior in proportion to the lowering of the grade. Concerning the washing fastness and the dry-cleaning fastness, 5th grade is best; and the respective fastnesses become inferior in proportion to the lowering of the grade. The light resistance was measured by the method of JIS L 0841, and the washing fastness and the dry-cleaning fastness were measured by the methods of JIS L 0844 and JIS L 0860, respectively.

This application is based on Japanese Patent Application No. JP 255904/96 filed Sep. 27, 1996, the entire contents of which are hereby incorporated by reference.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by letters: patent of the United States is:

1. A suede-like artificial leather, treated with a treatment comprising:

at least one dye selected from the group consisting of sulfur dyes, vat dyes and sulfur vat dyes; and a benzophenone compound represented by the following formula (3);

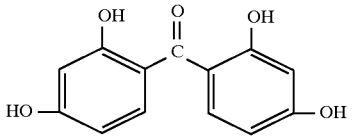

(3)

2. The suede-like artificial leather according to claim 1, wherein said suede-like artificial leather comprises an entangled non-woven fabric comprising microfine polyamide fibers and impregnated with a polyurethane.

3. The suede-like artificial leather according to claim 2, wherein said microfine polyamide fibers have an average single fineness of 0.5 denier or smaller.

4. The suede-like artificial leather according to claim 3, wherein the average single fineness of said microfine polyamide fibers is 0.1 denier or smaller.

5. The suede-like artificial leather according to claim 1, wherein said suede-like artificial leather comprises at least one napped surface and wherein said treatment is concentrated at said surface.

6. The suede-like artificial leather according to claim 5, wherein said napped surface comprises microfine polyamide fibers having an average single fineness of 0.5 denier or smaller.

7. The suede-like artificial leather according to claim 2, wherein said polyamide fibers comprise a polyamide polymer selected from the group consisting of 6-nylon, 6,6-nylon, 6,10-nylon, nylon having an aromatic group, and copolymers thereof.

8. The suede-like artificial leather according to claim 2, wherein said polyurethane comprises a polyurethane polymer or a copolymer of polyurethane with a polymer selected from the group consisting of polyether, polyester, polylactone, polycarbonate, and a mixture thereof.

9. The suede-like artificial leather according to claim 1, wherein said suede-like artificial leather comprises at least one surface, and wherein said treatment is concentrated at said surface.

10. A process for producing a suede-like artificial leather, which comprises:

dyeing a suede-like artificial leather with at least one dye selected from the group consisting of sulfur dyes, vat dyes and sulfur vat dyes; and treating the dyed artificial leather so obtained with a benzophenone compound represented by the following formula (3):

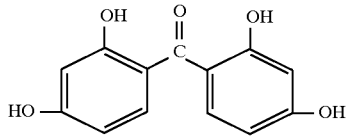

(3)

11. The process according to claim 10, wherein said suede-like artificial leather comprises an entangled non-woven fabric comprising microfine polyamide fibers and impregnated with a polyurethane.

12. The process according to claim 11, wherein said microfine polyamide fibers have an average single fineness of 0.5 denier or smaller.

13. The process according to claim 12, wherein the average single fineness of said microfine polyamide fibers is 0.1 denier or smaller.

14. The process according to claim 10, wherein said suede-like artificial leather comprises at least one napped surface.

15. The process according to claim 14, wherein said napped surface comprises microfine polyamide fibers having an average single fineness of 0.5 denier or smaller.

16. The process according to claim 11, wherein said polyamide fibers comprise a polyamide polymer selected from the group consisting of 6-nylon, 6,6-nylon, 6,10-nylon, nylon having an aromatic group, and copolymers thereof.

17. The process according to claim 11, wherein said polyurethane comprises a polyurethane polymer or a copolymer of polyurethane with a polymer selected from the group consisting of polyether, polyester, polylactone, polycarbonate, and a mixture thereof.

* * * * *